United States Patent [19]

Purcell et al.

[11] Patent Number: 5,035,182

[45] Date of Patent: Jul. 30, 1991

[54] BENDING TYPE ORDNANCE VENTING DEVICE

[75] Inventors: Nick L. Purcell; Joseph A. Schmidt; John A. O'Malley, all of Ridgecrest, Calif.

[73] Assignee: The United States of America as represented by the Secretary of the Navy, Washington, D.C.

[21] Appl. No.: 594,143

[22] Filed: Mar. 28, 1984

[51] Int. Cl.[5] ..... F42B 39/00

[52] U.S. Cl. ..... 102/481; 60/253; 102/374; 102/293; 220/89.1; 220/DIG. 27

[58] Field of Search ..... 60/223, 253, 254; 220/89 B, 89 A, 367, DIG. 27, 89.1, 89.4; 236/92 C; 102/374, 293, 481; 89/1 B, 1.14; 86/1 A, 50

[56] References Cited

U.S. PATENT DOCUMENTS

| | | | |
|---|---|---|---|
| 2,293,366 | 8/1942 | Solosko | 220/89 B |
| 2,426,808 | 9/1947 | Auer | 220/89 |
| 2,428,838 | 10/1947 | Derby | 200/140 |
| 2,679,467 | 5/1954 | Sherts | 154/2.73 |
| 2,920,790 | 1/1960 | Quenneville et al. | 220/89 |
| 3,201,174 | 8/1965 | Stanton | 301/5 |
| 3,269,402 | 8/1966 | Horner | 137/74 |
| 3,448,653 | 6/1969 | Myers | 102/293 |
| 3,887,991 | 6/1975 | Panella | 220/89 B |
| 3,916,818 | 11/1975 | Barr et al. | 236/92 C |
| 4,030,427 | 6/1977 | Goldstein . | |
| 4,067,154 | 1/1978 | Fike, Jr. | 52/99 |

*Primary Examiner*—Harold J. Tudor
*Attorney, Agent, or Firm*—Melvin J. Sliwka; Sol Sheinbein

[57] ABSTRACT

An ordnance venting system is provided to reduce the danger of explosion in ordance items exposed to fires and includes an ordnance item having a number of holes in the ordance casing, each hole being covered by a bimetallic patch which will deform when subjected to high temperatures, and each patch being attached by means such as brazing, soldering or adhesive bonding.

4 Claims, 1 Drawing Sheet

BENDING TYPE ORDNANCE VENTING DEVICE

BACKGROUND OF THE INVENTION

1. Field of the Invention

This invention relates to the field of venting systems. More particularly, this invention relates to ordnance venting systems for reducing the danger of explosion by an ordnance item subjected to an external fire.

2. Description of the Prior Art

Catastrophic fires have occurred aboard naval ships and resulted in substantial loss of life and material. Suppression of these fires have been hindered by the explosive behavior of ordnance items in the vicinity of the fires. Efforts have been made to modify ordnance items in missile systems to preclude explosion behavior or to extend the time prior to a violent reaction to a fire.

Previous venting devices have included vent plugs, welded in the side of a motor case. These plugs would activate when heated through the use of a bimetallic spring and rotate the plug to a release position. By the release of the plug, the propellant could be exposed and vented to the external fire. Unfortunately, many such prior devices have proven to be too costly and have adversely affected the performance or range of certain missiles.

SUMMARY OF THE INVENTION

The present invention provides a venting system to reduce the danger of explosion from an ordnance item or other potentially explosive container subjected to a fire. The ordnance venting system comprises: a casing having a plurality of holes in the casing; a bimetallic patch, adjacent said casing, covering each of said plurality of holes; and means for attaching each patch to the casing.

OBJECTS OF THE INVENTION

It is an object of the present invention to provide a venting system capable of reducing the likelihood of explosion in an ordnance item subjected to an external fire.

This and other objects, features and advantages of the invention will become apparent from the following detailed description.

DETAILED DESCRIPTION OF THE PREFERRED EMBODIMENT

Figure 1:
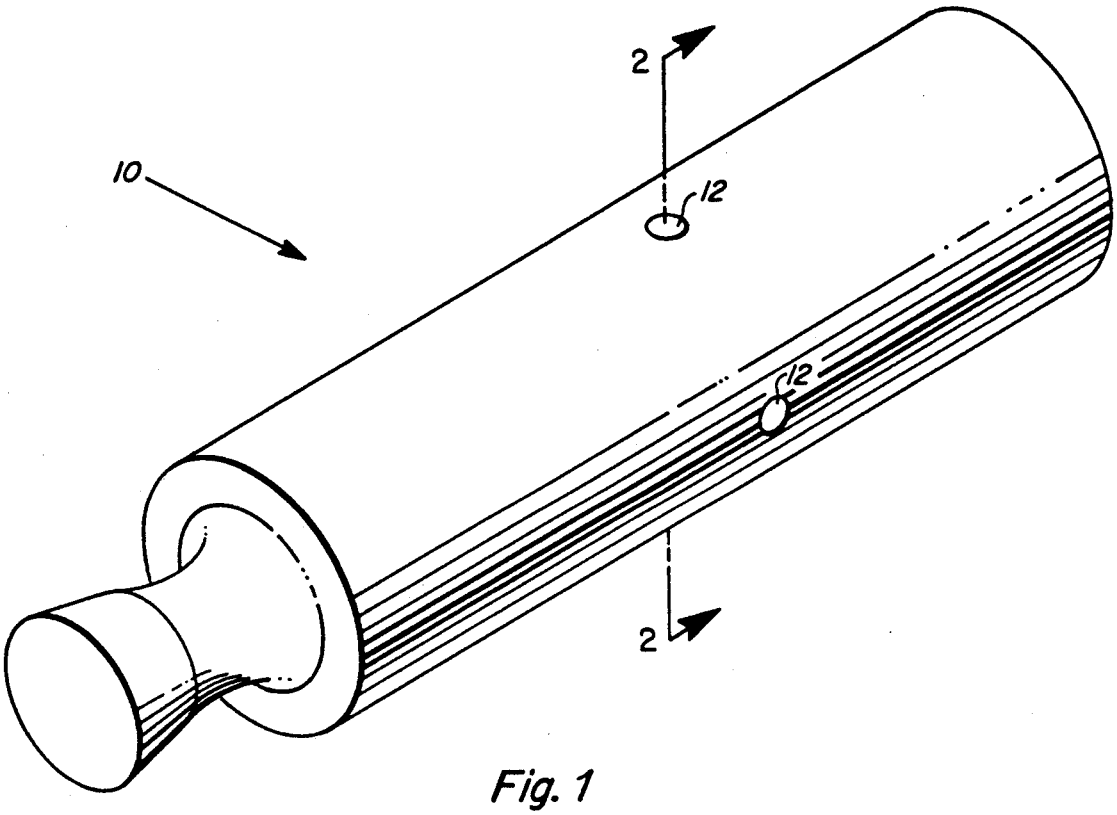
FIG. 1 is a view of a rocket motor, viewed from the nozzle and provided with the bimetallic patch venting system.
Figure 2:
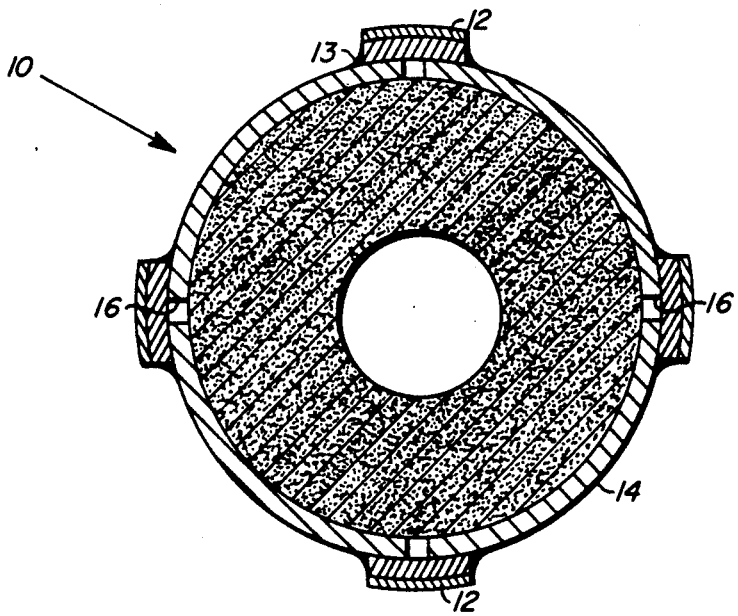
FIG. 2 is a cross-sectional view of the rocket motor along the line 2—2 of FIG. 1.

Referring to FIGS. 1 and 2, a rocket motor is shown utilizing the venting system of the present invention. A motor casing 10 has bimetallic patches 12 affixed adjacent to the casing. A number of holes 16 are provided in casing 10 and are covered by the bimetallic patches 12.

The principle of operation of the ordnance venting system is deformation of the bimetallic patches 12 when exposed to external heating. The patches are designed as bimetallic sandwiches that deform when heated. The stresses of the bending or deforming result in the separation of the patches from casing 10. A venting through holes 16 is then provided for propellant grain 14.

The bimetallic patches are attached to the casing by any suitable means. The use of braze 13, solder or adhesive can join or bond the patches to the casing. Selection of the metals for the bimetallic patch can yield different thermal expansion characteristics and provide a range of deformations. Other materials considered desirable as patches are nickel-titanium alloys having from 40 to 45 percent titanium and 55 to 60 percent nickel. Preformed NITINOL, a nickel-titanium alloy often described as the alloy with a memory, undergoes large deformations when exposed to heat and can be used in place of a bimetallic patch.

In the exposure to a fire the pyrolysis of a propellant liner can assist in the ejection or removal of a patch when internal pressure builds to levels of around 5 psi. Among suitable braze materials is the low temperature braze manufactured by Handy & Harmon, consisting of 5 percent silver and 95 percent cadmium and having a melting temperature of 740° F. Selected adhesives can be used to join the patches but can result in a shortened lifetime than with a braze joint.

Obviously, many modifications of the present invention are possible in light of the above teachings. It is to be understood, that within the scope of the appended claims the invention may be practiced other than as specifically described.

We claim:

1. An ordnance venting system to reduce the danger of explosion from an ordnance item subjected to a fire comprising:

a cylindrical casing having a plurality of spaced-apart holes in said cylindrical casing;

a bimetallic patch adjacent said casing, covering each of said plurality of holes; and means for attaching said patch to said casing.

2. An ordnance venting system according to claim 1 wherein said means for attaching said patch comprises a braze.

3. An ordnance venting system according to claim 1 wherein said means for attaching said patch comprises adhesive.

4. An ordnance venting system according to claim 2 wherein said braze comprises a material containing 5 percent by weight silver and 95 percent by weight cadmium whereby said material has a melting point of about 740° F.

* * * * *